US008854923B1

(12) United States Patent
Eyster

(10) Patent No.: US 8,854,923 B1
(45) Date of Patent: Oct. 7, 2014

(54) VARIABLE RESONANCE ACOUSTIC TRANSDUCER

(75) Inventor: Kurt G. Eyster, Portsmouth, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 519 days.

(21) Appl. No.: 13/242,366

(22) Filed: Sep. 23, 2011

(51) Int. Cl.
*H04R 17/00* (2006.01)
*B01B 1/06* (2006.01)

(52) U.S. Cl.
CPC .. *H04R 17/00* (2013.01); *B01B 1/06* (2013.01)
USPC ..... 367/155; 310/317

(58) Field of Classification Search
USPC ..... 367/155, 157
See application file for complete search history.

(56) References Cited

U.S. PATENT DOCUMENTS 3,093,760 A * 6/1963 Tarasevich ..... 310/321
3,401,377 A * 9/1968 Bartlett et al. ..... 365/145
3,462,746 A * 8/1969 Bartlett ..... 365/65
3,982,144 A * 9/1976 Rogers et al. ..... 310/337
3,992,693 A * 11/1976 Martin et al. ..... 367/155
4,237,399 A * 12/1980 Sakamoto ..... 310/317
4,446,544 A * 5/1984 Connolly, Jr. ..... 367/155
4,604,542 A * 8/1986 Thompson ..... 310/334
4,651,044 A * 3/1987 Kompanek ..... 310/323.17
4,695,988 A * 9/1987 Banno ..... 367/154
4,823,327 A * 4/1989 Hilmers ..... 367/157
4,855,963 A * 8/1989 Winbow et al. ..... 367/31
5,042,493 A * 8/1991 Saito et al. ..... 600/459
5,083,056 A * 1/1992 Kondou et al. ..... 310/332
5,220,538 A * 6/1993 Flanagan et al. ..... 367/157
5,229,978 A * 7/1993 Flanagan et al. ..... 367/157
5,247,954 A * 9/1993 Grant et al. ..... 134/184
5,410,205 A * 4/1995 Gururaja ..... 310/328
5,825,117 A * 10/1998 Ossmann et al. ..... 310/317
5,957,851 A * 9/1999 Hossack ..... 600/459
6,065,349 A * 5/2000 Edouard et al. ..... 73/861.18
6,310,427 B1 * 10/2001 Culbert et al. ..... 310/337
6,489,707 B1 * 12/2002 Guerrero ..... 310/334
6,821,252 B2 * 11/2004 Ingebrigtsen et al. ..... 600/459
7,093,343 B2 * 8/2006 Osborn ..... 29/594
7,221,077 B2 * 5/2007 Sawada ..... 310/369
7,285,898 B2 * 10/2007 Sawada ..... 310/334
7,344,501 B1 * 3/2008 Mohr et al. ..... 600/459
7,483,339 B2 * 1/2009 Deangelis et al. ..... 367/159
7,994,689 B2 * 8/2011 Sawada et al. ..... 310/334
2006/0049715 A1 * 3/2006 Onishi ..... 310/317
2008/0129416 A1 * 6/2008 Volatier et al. ..... 333/191
2011/0204995 A1 * 8/2011 Jamneala et al. ..... 333/187
2011/0204996 A1 * 8/2011 Gilbert et al. ..... 333/191
2011/0204997 A1 * 8/2011 Elbrecht et al. ..... 333/191

* cited by examiner

*Primary Examiner* — Luke Ratcliffe
*Assistant Examiner* — Hovhannes Baghdasaryan
(74) *Attorney, Agent, or Firm* — James M. Kasischke; Michael P. Stanley

(57) ABSTRACT

A transducer assembly is provided for projecting acoustic signals into a medium. The assembly includes a support member having first and second layers of piezoelectric material mechanically linked to the support member. The first and second layers are joined to electrical drive circuitry such that one layer receives a driving voltage signal while the other layer receives the driving voltage with a stiffening voltage. The transducer assembly can use both the 3-1 and 3-3 drive modes. Multiple configurations are supported, and both bender bar and slotted cylinder configurations are shown.

20 Claims, 4 Drawing Sheets

VARIABLE RESONANCE ACOUSTIC TRANSDUCER

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER PATENT APPLICATIONS

None.

BACKGROUND OF THE INVENTION

1) Field of the Invention

The invention relates generally to increasing the efficiency and frequency band of operation of all transducers/projectors, and particularly slotted cylinder projectors.

2) Description of the Prior Art

It is known to provide slotted cylinder projectors and piezoelectric transducer assemblies. FIG. 1 shows a cross-sectional view of one such prior art transducer. A slotted cylinder transducer 10 features a hollow support member 12 in a cylindrical configuration and having an axial opening 14. The diameter of the support member 12 is D. Transducer material 16 is supported concentrically within the support member and is typically of a piezoelectric material and provided with an axial opening. The outer support member 12 may be thinned at selected locations to facilitate control of vibrational frequency and frequency bandwidth of the transducer assembly. The thinned portions of the support member 12 may be adapted to retain a compliant material, such as urethane, to smooth the outer surface of the support member 12. The hollow interior 14 of the transducer assembly 10 may be filled with a compliant material, such as urethane. The support member 12 is provided with an axially extending side opening 18, and the transducer material 16 is similarly provided with an axially extending side opening 20, the two side openings 18 and 20 being aligned with each other. Side openings 18 and 20 give a slot having dimension "g". Bending nodes 22 and 24 occur in the transducer 10 opposite side openings 18 and 20. Transducer 10 bends as shown at arrows 26. The slotted cylinder projector operates in a bending mode in a manner analogous to other resonant objects forced by piezoelectric components. These include tuning forks and vibrating cantilevers.

Piezoelectric material must be polled before it can be used as a transducer. Polling involves raising the temperature of the material and putting an electric field across the material in the same direction that a field will be applied to the material in use. When the piezoelectric strain is desired in a different dimension from the direction of electric field application and polling, the transducer material is known as a 3-1 transducer material. In a 3-3 piezoelectric material, strain is produced in the same direction as the polling direction and application of the electric field.

When electrical signals are introduced to the transducer material 16, the transducer material 16 vibrates. The outer support member 12 limits the amplitude of the vibrations of the transducer material 16. Such transducers 10 are generally referred to as slotted cylinder projectors and are capable of providing low frequency acoustics. Slotted cylinder projectors are efficient and small in size, and provide sufficient power to find application in underwater sonar projectors.

The resonant frequency ($F_r$) of a slotted cylinder projector is proportional to the square root of Young's modulus, Y, of support member 12:

$$F_r \cong .0655 \times \frac{ct}{D^2} = .0655 \times \frac{t}{D^2}\sqrt{\frac{Y}{p}} \tag{1}$$

wherein c is sound speed, t is thickness, D is the diameter of the inner ring, Y is the effective Young's modulus, and ρ is the effective density of support member 12.

An equivalent circuit model developed based upon kinetic and potential energies of a slotted cylinder of length L, effective density (ρ), effective Young's modulus (Y), length of the cylinder L, thickness t, diameter of the inner ring $D_1$ wherein M=dynamic mass and $K^E$=stiffness, comprises:

$$M=5.4\rho LtD,$$

and $$K^E=0.99YL(t/D)^3 \tag{2}$$

FIG. 2 shows a prior art transducer 30 known as a bender bar joined to a typical electrical driver 32 represented by an alternating current voltage source. Bender bar 30 includes a flexible bar 34 having a transducer member 36A and 36B positioned on either side of bar 34. First electrodes 38A and 38B are positioned on a first side of each transducer member 36A and 36B, and second electrodes 40A and 40B are positioned on a second side of each transducer member 36A and 36B. Insulation 42 is provided to insulate flexible bar 34 from electrodes. As shown, transducer member 36A is poled in the opposite direction from transducer member 36B. The contraction and expansion of transducer members 36A and 36B causes flexible bar 34 to bend in response thereto. When subjected to a voltage from electrical driver 32, this different poling causes transducer member 36B to contract when transducer member 36A expands resulting in bending shown at 44B. When the voltage is reversed, bending reverses to that shown at 44A. Rapidly changing the applied electrical signal causes vibrations in the bender bar 30.

Acoustic transducers and more particularly slotted cylinder projectors are often used in high pressure environments and environments with varying temperatures. These environmental conditions change the resonance frequency of the transducer and cause the transducer to become inefficient and mismatched to its power amplifier.

SUMMARY OF THE INVENTION

There is provided herein a transducer assembly for projecting acoustic signals into a medium. The assembly includes a support member having first and second layers of piezoelectric material mechanically linked to the support member. The first and second layers are joined to electrical drive circuitry such that one layer receives a driving voltage signal while the other layer receives the driving voltage with a stiffening voltage. The transducer can use both the 3-1 and 3-3 drive modes. Multiple configurations are supported, and both bender bar and slotted cylinder configurations are shown.

BRIEF DESCRIPTION OF THE DRAWINGS

Reference is made to the accompanying drawings in which are shown illustrative comparative devices, as well as an illustrative embodiment of the invention, from which its novel features and advantages will be apparent, and wherein corresponding reference characters indicate corresponding parts throughout the several views of the drawings, and wherein.

DETAILED DESCRIPTION OF THE INVENTION

Figure 1:
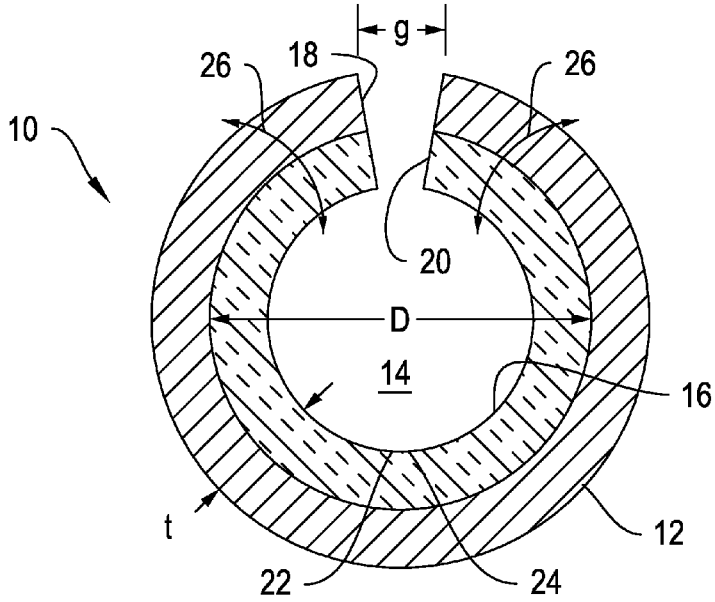
FIG. 1 (PRIOR ART)
FIG. 1 is a diagrammatic cross-sectional view of a prior art slotted cylinder projector.
Figure 2:
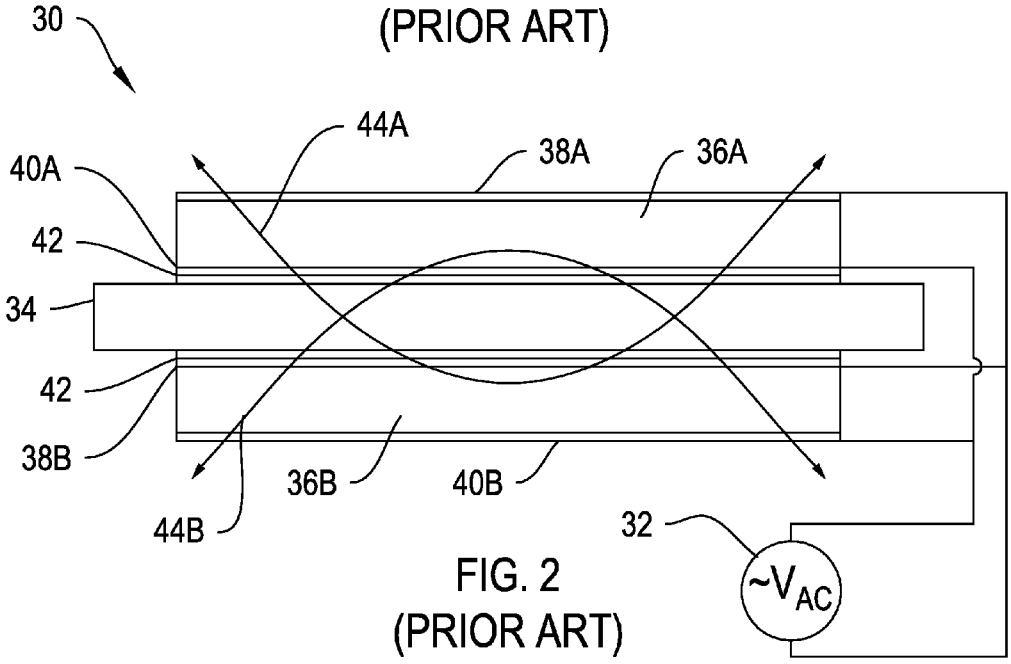
FIG. 2 (PRIOR ART)
FIG. 2 is a diagrammatic view of a prior art piezoelectric trilaminar bender bar.
Figure 3:
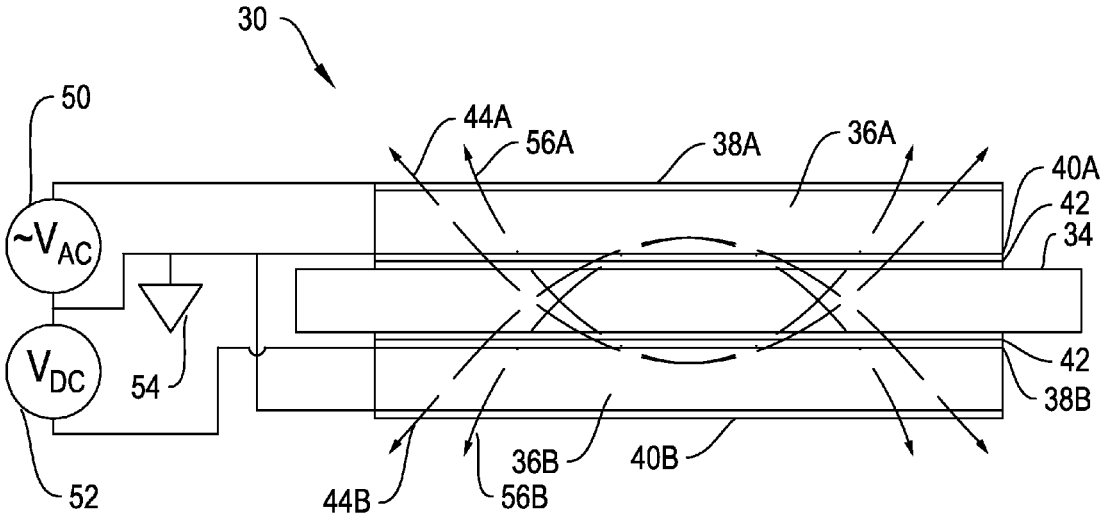
FIG. 3 is a diagram of a trilaminar bender bar according to the current invention.

FIG. 3 shows an embodiment of the current invention as applied to a bender bar 30. The bender bar 30 has a flexible bar 34 joined to transducer member 36A and 36B positioned on either side of bar 34. Electrodes 38A and 38B are positioned in electrical contact on a first side of each transducer member 36A and 36B, and second electrodes 40A and 40B are positioned in electrical contact on a second side of each transducer member 36A and 36B. Insulation 42 is provided to insulate flexible bar 34 from electrodes. Transducer member 36A is poled in the opposite direction from transducer member 36B. This embodiment gives a 3-1 mode of transducer material operation. In this embodiment the transducer members 36A and 36B and flexible bar 34 are operationally the same as used in the prior art.

Bender bar 30 is joined to a different electrical driver 48 that allows application of a direct current bias to transducer member 36B. Electrical driver 48 has an alternating voltage signal generator 50 and a direct current bias voltage generator 52. Direct current bias voltage generator 52 is joined to apply a bias voltage to transducer member 36B. A ground 54 is also provided.

Applying a bias voltage to one of the transducer members changes the resonance frequency of the bender bar 30 by pre-stressing or de-stressing the bar. For example, curves 44A and 44B show bending of bender bar 30 before application of a bias voltage from direct current bias voltage generator 52. After application of a direct current, bender bar 30 bends according to curves 56A and 56B. Direct current bias voltage can be changed in accordance with environmental or operational parameters to move the resonance frequency as necessary.

Figure 4:
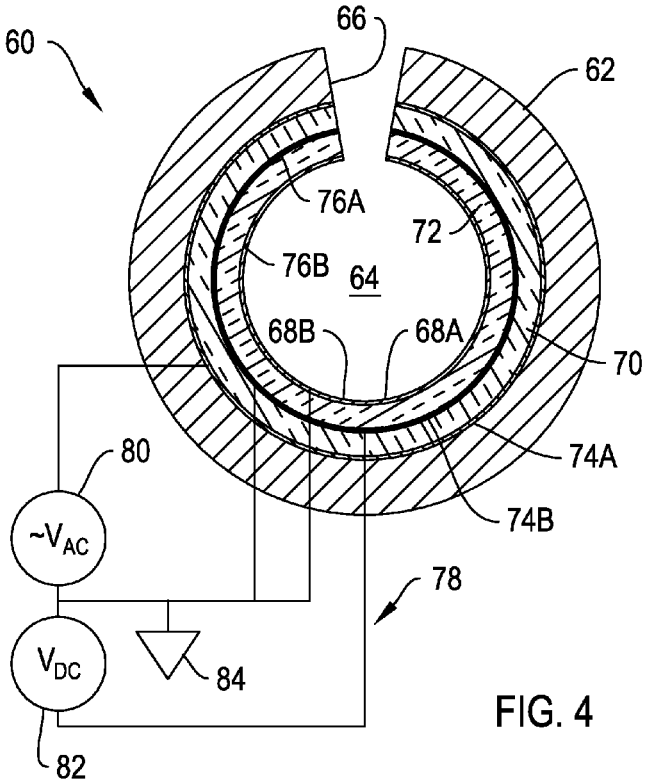
FIG. 4 is a diagrammatic cross-sectional view of a slotted cylinder projector using 3-1 drive mode according to the current invention.

FIG. 4 shows a cross-sectional view of another embodiment of the current invention. This embodiment provides a slotted cylinder acoustic projector 60 that includes a cylindrical support member 62 having a hollow axial region 64. Support member 62 has a longitudinal slot 66 formed therein. Transducer assembly 60 will have nodes 68A and 68B 180° around support member 62 from slot 66. A slotted cylinder support member 62 can be made from steel, aluminum, graphite or other rigid material. For in-water applications, an outer water barrier, such as a rubber boot (not shown), can be used.

A first transducer material layer 70 is disposed on the interior surface of support member 62. First transducer material layer 70 conforms to the interior surface of support member 62. A second transducer material layer 72 is disposed on the interior surface of first transducer material layer 70. The transducer material for both layers is preferably a piezoelectric material such as a piezoceramic composite. First transducer material layer 70 has electrical contacts 74A and 74B that are in contact with the transducer material layer 70 and insulated from electrical contact with other components. Second transducer material layer 72 has electrical contacts 76A and 76B in contact with second transducer material layer 72 and insulated to prevent electrical contact with other components. First transducer material layer 70 and second transducer material layer 72 are thus configured for 3-1 transducer mode operation because the electric field is provided in a different direction from the piezoelectric strain.

An electrical drive circuit 78 is provided for transducer assembly 60. Drive circuit 78 has an alternating voltage signal generator 80 and a direct current bias voltage generator 82. Alternating voltage signal generator 80 is joined to electrodes 76A and 76B on second transducer material layer 74. Direct current bias voltage generator 82 is joined to apply a bias voltage to transducer member 70 in addition to the voltage from signal generator 80. A ground 84 is also provided. Bias voltage provided to transducer member 70 changes its stiffness and alters the resonant frequency of transducer assembly 60. Other known circuitry can be provided to control bias voltage with respect to environmental conditions and resonance frequency.

In accordance with the present invention, first transducer material layer 70 has a maximum affect on the resonance frequency change of assembly 60 when located in the vicinity of 180° across from the slot 66 and extending slightly beyond the nodes (68A and 68B). There is no requirement that the entire interior surface of support member 62 be covered by or joined to transducer layer 70.

Figure 5:
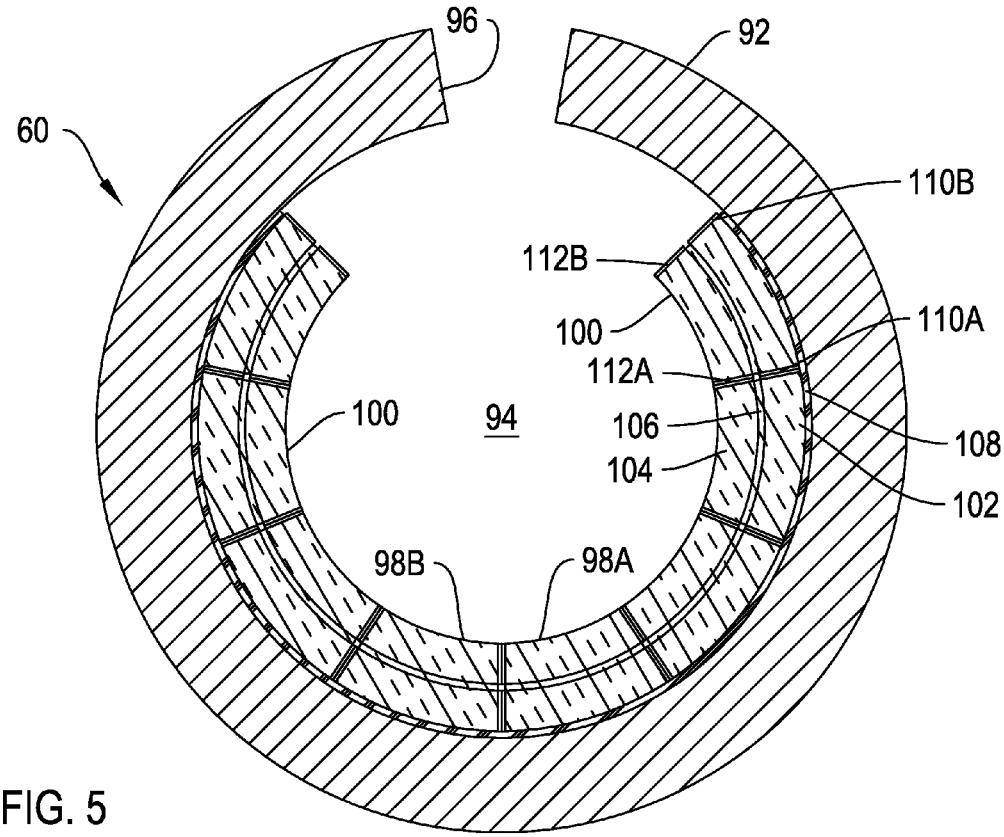
FIG. 5 is a diagrammatic cross-sectional view of a slotted cylinder projector using 3-3 drive mode according to the current invention.

FIG. 5 shows an alternate embodiment of the current invention having a slotted cylinder projector or transducer assembly 90 utilizing a 3-3 mode of transducer operation. A detail view of one portion of this embodiment is given in FIG. 6. Transducer assembly 90 has an outer shell or support member 92. In this embodiment support member 92 is cylindrical having an axial hollow 94. A slot 96 is formed in a portion of the support member 92. When vibrating, nodes 98A and 98B will occur in the transducer assembly 90 opposite of slot 96. Wedge shaped transducer portions 100 are distributed around the interior surface of support member 92. Transducer portions 100 can be made from a single piece of piezoelectric material.

For purposes of reference, wedge shaped transducer portions can be referenced as arcuate wedges. These arcuate wedges have a major arcuate surface positioned against the interior of support member 92. A minor arcuate surface is opposite the major arcuate surface in the support member hollow 94. Each wedge portion has first and second radial surfaces adjacent to other wedge portions. First and second transverse surfaces of the wedge portions are provided perpendicular to the axis of the support member.

Each transducer portion 100 includes a first region 102 poled in a first direction and a second region 104 poled in a second direction. (The first direction and the second direction can be the same direction). For 3-3 operation it is preferred that the poling be from one radial surface to another. An inactive region 106 is positioned between the first region 102 and the second region 104. Inactive region 106 is not poled. Transducer portions 100 are insulated from electrical contact with support member 92 by insulation 108. Inactive region 106 can act as effective insulation between first region 102 and second region 104. As an alternative, first region 102 can be formed separately from second region 104, and inactive layer 106 can be a non-conducting adhesive.

Figure 6:
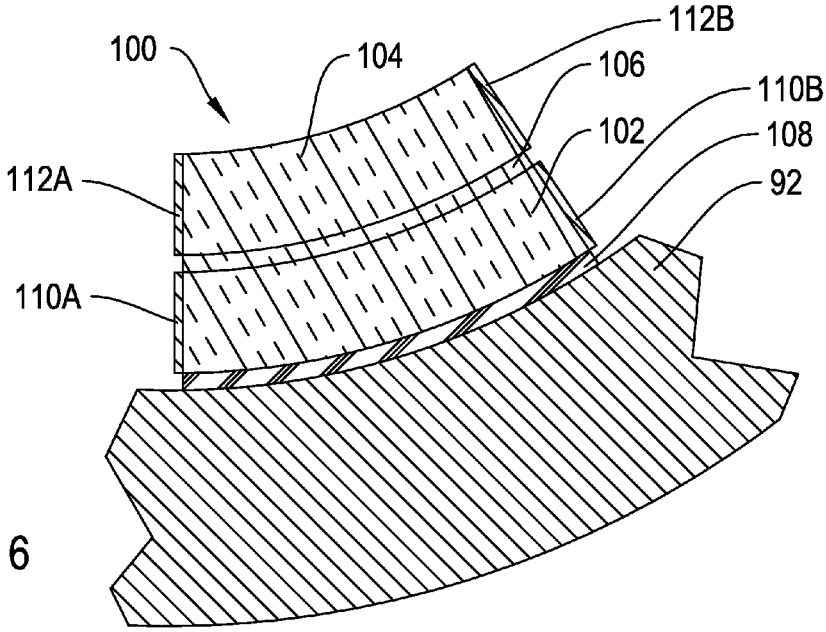
FIG. 6 is a detail view of one portion of the transducer provided in FIG. 5.

As may best be seen in FIG. 6, one transducer portion 100 is shown. First region 102 has electrodes 110A and 110B positioned on the first radial surface and the second radial surface of portion 100. Second region 104 has electrodes 112A and 112B disposed on the first and second radial surfaces of portion 100. The first region electrodes 110A and 110B of each portion 100 are together joined to an electrical circuit much like that shown at 78 in FIG. 4 in order to provide a driving voltage with a bias voltage. Electrodes 112A and 112B of each portion 100 are joined to the electrical circuit to provide a driving voltage to second regions 104. Adjacent electrodes on different portions are insulated from each other.

Figure 7:
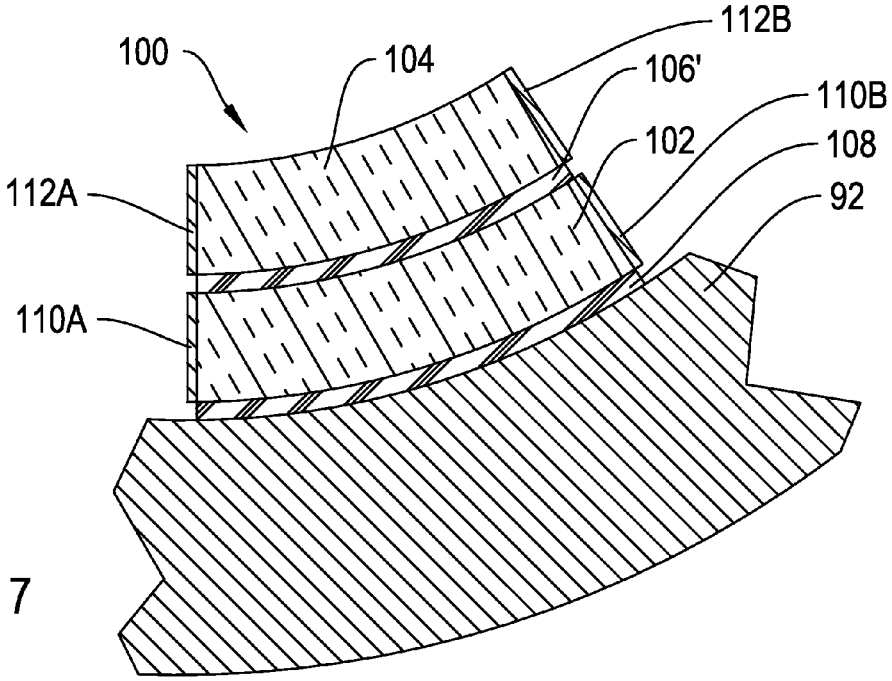
FIG. 7 is a detail view showing an alternate embodiment of one portion of the transducer.

In FIG. 7, there is shown an alternate embodiment of the transducer portion 100. In this embodiment, a dielectric or insulating material 106' is utilized between first region 102 and second region 104. Insulating material 106' has no piezoelectric properties. This embodiment could be easier to manufacture than that shown in FIG. 6.

In one embodiment, first region 102 is poled in an opposite direction from second region 104. This allows opposite piezoelectric strain induction with a voltage having the same polarity on adjacent electrodes. In another embodiment, first region 102 and second region 104 are poled in the same direction. Magnitude of the piezoelectric strain induction can be controlled by providing different voltages to different electrodes.

There is thus provided an acoustic transducer wherein the stiffness thereof is variable, using at least two actively polled piezoelectric slotted cylinder projector layers within the slotted cylinder projector. Further, dynamic slotted cylinder projector nodes provide for active stiffness control of the split ring transducer by having the un-polled piezoelectric volume located between two active piezoelectric volumes, per FIGS. 5 and 6. Further, the dead piezoelectric volume offers a dynamic node region, the two piezoelectric volumes being voltage and phase controlled in order to achieve desired performance at various operating conditions and operating performances. Other benefits include the ability to drive the two polarized piezoelectric volumes in order to achieve the desired frequency operating bandwidth, the ability to shift the resonant frequency to the desired frequency of operation (operating at resonance allows maximum operating efficiency), the ability to drive the two polarized piezoelectric volumes in order to achieve the greatest efficiency at the optimal design frequency, resulting in decrease in operating bandwidth; and optimization of the two drive voltage magnitudes and phases at various ambient pressures to achieve the maximum frequency bandwidth, greatest efficiency, and desired performance.

Controlling the resonance frequency makes possible highly efficient transducer assembly operation obtained from operating close to, or at, resonance. The control of the resonance of the transducer assembly with the open and short circuit stiffness of the active piezoelectric material is used to drive the transducer assembly. Increasing the DC bias ($V_{dc}$) on the PZT driver stiffens the transducer assembly resulting increased resonance frequency. The resonance frequency is directly proportional to the Young's modulus of the assembly as seen in Equation 1.

It will be appreciated that this invention is applicable to all transducer/projectors and not limited to slotted cylinder projectors. Improved efficiency and band width can be realized on all transducers using this proposed active variable compliance, i.e. active stiffening.

It will be understood that many additional changes in the details, materials, steps and arrangement of parts, which have been herein described and illustrated in order to explain the nature of the invention, may be made by those skilled in the art within the principles and scope of the invention as expressed in the appended claims.

What is claimed is:

1. A transducer assembly comprising:

a support member;

a first layer of piezoelectric material mechanically joined to said support member for providing strain in a first desired direction that affects said assembly, said first layer having first layer electrodes;

a second layer of piezoelectric material mechanically joined to said support member for providing strain in a second desired direction that affects said assembly, said second layer having second layer electrodes;

electrical drive circuitry joined to said first layer electrodes and said second layer electrodes, said electrical drive circuitry being configured to provide a driving voltage to one of said first layer electrodes and said second layer electrodes and being configured to provide the driving voltage with a stiffening voltage to the other of said first layer electrodes and second layer electrodes, wherein said electrical drive circuitry further comprises a controller configured to calculate and adjust the magnitude of said stiffening voltage based on a desired transducer assembly resonance frequency and environmental conditions.

2. The apparatus of claim 1 wherein:

said first layer electrodes are positioned to provide the driving voltage in the first desired direction; and said second layer electrodes are positioned to provide the driving voltage in the second desired direction.

3. The apparatus of claim 2 wherein:

said support member is a bar having a first major surface and a second major surface opposite said first major surface;

said first layer being joined to the first major surface; and said second layer being joined to the second major surface.

4. The apparatus of claim 2 further comprising:

an insulating layer positioned between said first layer and said second layer;

wherein:

said support member is a hollow tubular outer shell having a slot extending lengthwise therethrough, the outer shell having an interior surface;

said second layer has a major arcuate surface joined to the shell interior surface, said second layer having a minor arcuate surface opposite said major arcuate surface;

said insulating layer is joined to said second layer minor arcuate surface; and said first layer has a major arcuate surface joined to said insulating layer.

5. The apparatus of claim 4 wherein:

said first layer, said second layer, and said insulating layer are formed from a plurality of wedges of piezoelectric material having first and second radial surfaces, said wedges being arranged adjacent to one another on said shell interior surface and jointly forming said first layer, said second layer and said insulating layer;

each said wedge having a first layer portion, a second layer portion and an insulating portion, said first layer electrodes being positioned on the first and second radial surfaces of said wedge adjacent to the first layer portion, said second layer electrodes being positioned on the first and second radial surfaces of said wedge adjacent to the second layer portion, the insulating portion being an arcuate portion of said wedge without electrodes positioned on its radial surface.

6. The apparatus of claim 5 wherein said first layer portion is poled in a first direction, and said second layer portion is poled in a second direction opposite from the first direction.

7. The apparatus of claim 5 wherein said first layer portion is poled in a first direction, and said second layer portion is poled in a second direction the same as the first direction.

8. The apparatus of claim 4 wherein:

said first layer electrodes are joined to said drive circuitry to receive the driving voltage;

said second layer electrodes are joined to said electrical drive circuitry to receive the driving voltage with the stiffening voltage.

9. The apparatus of claim 4 wherein:

said second layer electrodes are joined to said drive circuitry to receive the driving voltage; and said first layer electrodes are joined to said electrical drive circuitry to receive the driving voltage with the stiffening voltage.

10. The apparatus of claim 1 wherein:

said first layer electrodes are positioned to provide the driving voltage perpendicular to the first desired direction; and said second layer electrodes are positioned to provide the driving voltage perpendicular to the second desired direction.

11. The apparatus of claim 10 wherein:

said support member is a bar having a first major surface and a second major surface opposite said first major surface;

said first layer being joined to the first major surface; and said second layer being joined to the second major surface.

12. The apparatus of claim 10 wherein:

said support member is a bar having a first major surface and a second major surface opposite said first major surface;

said first layer having a top surface and a bottom surface, said first layer bottom surface being joined to the first major surface; and said second layer being joined to the first layer top surface.

13. The apparatus of claim 10 further comprising:

an insulating layer positioned between said first layer and said second layer;

wherein:

said support member is a hollow tubular outer shell having a slot extending lengthwise therethrough, the outer shell having an interior surface;

said second layer has a major arcuate surface joined to the shell interior surface, said second layer having a minor arcuate surface opposite said major arcuate surface;

said insulating layer is joined to said second layer minor arcuate surface; and said first layer has a major arcuate surface joined to the insulating layer.

14. The apparatus of claim 13 wherein:

said first layer electrodes are joined to said drive circuitry to receive the driving voltage;

said second layer electrodes are joined to said electrical drive circuitry to receive the driving voltage with the stiffening voltage.

15. The apparatus of claim 13 wherein:

said second layer electrodes are joined to said drive circuitry to receive the driving voltage; and said first layer electrodes are joined to said electrical drive circuitry to receive the driving voltage with the stiffening voltage.

16. The apparatus of claim 1 wherein said support member is made from a conductive material; and said first layer and said second layer are electrically insulated from said support member.

17. A transducer assembly comprising:

a support member having a hollow tubular outer shell having a slot extending lengthwise therethrough, the outer shell having an interior surface;

a first layer of piezoelectric material segments, each having a major arcuate surface and two radial faces, and configured to provide strain in a first desired direction that affects said assembly, said first layer segments having first layer electrodes on the radial faces;

a second layer of piezoelectric material segments, each having a major arcuate surface joined to said support member interior surface and two radial faces, said second layer having a minor arcuate surface opposite said major arcuate surface, said second layer being configured to provide strain in a second desired direction that affects said assembly, said second layer segments having second layer electrodes on the radial faces;

an insulating layer positioned between said first layer major arcuate surface and said second layer minor arcuate surface;

electrical drive circuitry joined to said first layer electrodes and said second layer electrodes, said electrical drive circuitry being configured to provide a driving voltage to one of said first layer electrodes and said second layer electrodes and being configured to provide the driving voltage with a stiffening voltage to the other of said first layer electrodes and second layer electrodes wherein said first layer electrodes are positioned to provide the voltage perpendicular to the first desired direction, and said second layer electrodes are positioned to provide the voltage perpendicular to the second desired direction.

18. The apparatus of claim 17 wherein said insulating layer comprises an unpoled portion of piezoelectric material.

19. The apparatus of claim 17 wherein:

said first layer electrodes are joined to said drive circuitry to receive the driving voltage;

said second layer electrodes are joined to said electrical drive circuitry to receive the driving voltage with the stiffening voltage.

20. The apparatus of claim 17 wherein:

said second layer electrodes are joined to said drive circuitry to receive the driving voltage; and said first layer electrodes are joined to said electrical drive circuitry to receive the driving voltage with the stiffening voltage.

* * * * *